United States Patent [19]

Weyer

[11] Patent Number: 4,987,825

[45] Date of Patent: Jan. 29, 1991

[54] ACTUATOR WITH FLUID TRANSFER TUBES

[76] Inventor: Paul P. Weyer, 48811 284th S.E., Enumclaw, Wash. 98022

[21] Appl. No.: 370,640

[22] Filed: Jun. 23, 1989

[51] Int. Cl.[5] ..... F01B 21/00

[52] U.S. Cl. ..... 92/2; 92/31; 92/65

[58] Field of Search ..... 92/2, 31, 32, 33, 52, 92/53, 65, 111, 112; 91/508; 901/22, 41

[56] References Cited

U.S. PATENT DOCUMENTS

| | | | |
|---|---|---|---|
| 2,832,317 | 4/1958 | Henry | 92/111 |
| 2,918,799 | 12/1959 | Geyer | 92/33 |
| 2,955,579 | 10/1960 | Block | 92/33 |
| 4,489,624 | 12/1984 | Schaib et al. | 91/508 |
| 4,513,644 | 4/1985 | Weyer . | |
| 4,559,895 | 12/1985 | Kijima et al. | 92/65 |
| 4,590,816 | 5/1986 | Weyer . | |
| 4,593,605 | 6/1986 | Goodell | 901/22 |
| 4,741,250 | 5/1988 | Weyer . | |
| 4,846,007 | 7/1989 | Weyer . | |

OTHER PUBLICATIONS

Vertical Machining Center MV-45m NC-55 Mori--Seiki; Brochure, 8 pages.

*Primary Examiner*—Edward K. Look
*Assistant Examiner*—F. Daniel Lopez
*Attorney, Agent, or Firm*—Seed and Berry

[57] ABSTRACT

A fluid-powered actuator for selectively rotating and linearly moving an external device with two fluid ports to communicate pressurized fluid thereto for its operation. The actuator includes a body having a rotatable shaft extending therewithin. The shaft has a chamber with a forward opening and a rearward wall. A first piston is mounted for reciprocal axial movement within said body and means are provided for transmitting torque between the body and shaft to produce rotational movement of the shaft in response to axial movement of the first piston. A second piston having bores extend fully therethrough extends within said shaft chamber and is supported for axial movement relative to said shaft. The external device is attached to the second piston at its forward end. Three rigid tubes have a rearward end portion fixedly positioned in bores in the shaft rearward wall and extend forward into the second piston bores a sufficient axial distance to maintain the tubes at least partially therewithin as the second piston axially reciprocates within said shaft chamber. The second piston is slidably disposed on the tubes which restrain the second piston against rotational movement. The tubes each have an interior conduit for communicating pressurized fluid between ports in the body and the external device and a remote side of the second piston. In an alternative embodiment, torque rods restrain the second piston against rotation.

9 Claims, 6 Drawing Sheets

FIG. 6
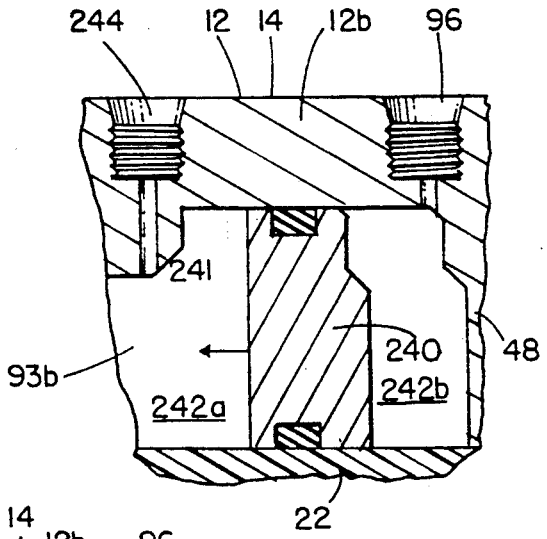
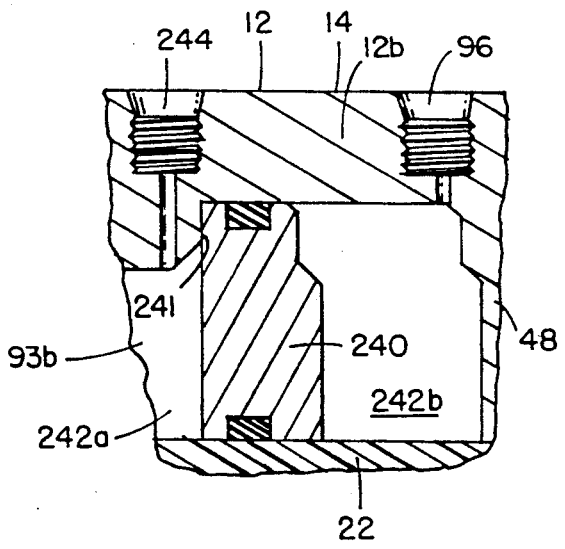
FIG. 7

ACTUATOR WITH FLUID TRANSFER TUBES

DESCRIPTION

1. Technical Field

The present invention relates generally to actuators, and more particularly, to fluid-powered actuators used to selectively rotate and linearly move another fluid-powered device attached thereto, and selectively and remotely operate the device under fluid-power when at the various positions to which it is moved.

2. Background of the Invention

It is sometimes necessary to rotationally and longitudinally move with precision a fluid-powered device to a desired position, and then selectively and remotely operate the device under fluid-power when at the various positions to which moved. One particular such device is an automatic tool changer used with machining equipment to automatically exchange just used tools for a new tool of a different size or type so that the machining job can quickly continue, without the operator being required to manually change the tools.

Such tool changers frequently include a pair of gripper arms each having a gripper at a distal end thereof controlled by the selective application of high pressure hydraulic fluid to the fluid ports of the tool changer. The gripper arms are moved about by an actuator to place the gripper at the end of one arm in the desired position to grasp a new tool from a tool carousel or to return a just used tool to the carousel, and to place the gripper at the end of the other arm in the desired position to grasp a just used tool from the machine work spindle or to insert a new tool therein. Depending on the style of the tool changer used, the two grippers can be simultaneously or independently actuated, and each gripper can be actuated by the application of pressurized fluid to either fluid-drive the gripper into both the open or closed positions or fluid-drive the gripper into only one position with a spring supplying drive to return the gripper to the other position. Of course, more than two gripper arms can be utilized if desired, and the gripper arms can be designed to be extendable if a greater reach is needed.

As such, remote operation of the tool changer gripper arms requires the tool changer to have from a minimum of one fluid port to as many as two to six or more fluid ports. Each of these fluid ports must be separately supplied with high pressure hydraulic fluid. This presents a problem since the tool changer is frequently moved about by the tool changer actuator, with both rotational and longitudinal motion, so as to position the grippers at the tool carousel or the machine spindle, as needed, to insert and remove tools.

For a typical tool changer with two gripper arms, the tool changer actuator must longitudinally and rotationally move the gripper arms from an out of the way neutral position to a start position to commence the exchange of a new tool for a just used tool. The actuator then longitudinally moves the gripper arms inward to place one gripper at the carousel and the other gripper at the machine spindle to grasp the new tool and the just used tool. When the grippers are actuated to securely grasp their respective tools, the actuator longitudinally moves the gripper arms outward to remove the grasped tools from the carousel and the spindle. Next, the actuator must rotate the gripper arms by 180 degrees to place the gripper with the just used tool at the carousel and the gripper with the new tool at the spindle. Then the actuator longitudinally moves the gripper arms inward to position the new tool in the spindle and the just used tool in the carousel for storage until needed again. The actuator must then longitudinally and rotationally move the gripper arms to return the gripper arms to the neutral position out of the way of the spindle so they do not interfere with the machining operation to be continued with the new tool. When it is desired to replace the new tool with yet another tool, the process is repeated.

Of course, depending on the particular placement of the machine spindle, the carousel and the tool changer actuator, and the particular style of the carousel and tool changer being used, other and different motions and sequences of motions must be used. With the complexity of motion involved, it is readily apparent that providing a reliable fluid supply to the tool changer fluid ports for operation of the grippers as the tool changer is moved about, is difficult. Attaching flexible hoses to the tool changer using swivel joints is not a satisfactory solution.

In the past, to achieve the precision and complexity of motion required for tool changers to accurately and properly place the grippers in the desired positions, the tool changer actuators used have been undesirably bulky, expensive and overly complicated in design. The space taken up by the actuator makes location of the actuator in a convenient position adjacent to the machine spindle and the tool carousel difficult. The complicated designs used have resulted in not only large actuators, but actuators more expensive, and less reliable and accurate than desired.

It will therefore be appreciated that there has been a significant need for a fluid-powered actuator for selectively rotating and linearly moving with precision a fluid-powered external device, such as a tool changer, while supplying a pressurized fluid supply to the fluid parts of the external device to selectively and remotely operate the device when at the various positions to which moved by the actuator. The actuator should be compact in design to facilitate location of the actuator in situations where limited space is available or to satisfy the desire for a small actuator exterior envelope. The actuator should also be relatively simple in construction to provide reliable performance and reduce the cost of manufacturing. The present invention fulfills these needs, and further provides other related advantages.

DISCLOSURE OF THE INVENTION

The present invention resides in a fluid-powered actuator for selectively rotating and linearly moving a fluid-powered external device with at least one fluid port to communicate pressurized fluid thereto for the operation of the external device. The actuator has an outer body with a forward end and a rearward end and a body chamber axially extending therebetween within the body. A first member extends generally coaxially within the body chamber and is supported for rotational movement relative to the body. The first member has a forward end toward the body forward end and a rearward end with a rearward wall toward the body rearward end. This rearward wall has a plurality of recesses opening at a face thereof toward the first member rearward end to and fully through a face thereof toward the first member forward end. The first member further has a chamber extending longitudinally and generally axially through the first member from the rearward wall fully through to the first member forward end to define a chamber end opening at the first member forward end.

A first piston is mounted for reciprocal axial movement within the body chamber in a response to the application of fluid pressure to one or the other opposing axial sides thereof. A pair of first fluid ports are provided to selectively communicate pressurized fluid to the opposing sides of the first piston. First means are included for transmitting torque between the body and the first member to produce rotational movement of the first member relative to the body in response to axial movement of the first piston.

The actuator further includes a second member extending generally axially within the first member chamber and supported for axial movement relative to the first member. The second member projects forwardly beyond the chamber end opening, and has a forward end and a rearward end with a plurality of apertures extending generally axially through the second member from the second member rearward end to a position toward the second member forward end. The second member apertures include a piston aperture, and at least one device drive aperture extending fully through to the second member forward end to define an end opening at the second member forward end. The second member apertures are in generally axial alignment with the first member recesses in the rearward wall.

A second piston is mounted for reciprocal axial movement within the first member chamber in response to the application of fluid pressure to one or the other opposing axial sides thereof. The second piston operatively engages the second member to produce axial movement of the second member relative to the first member. The piston drive aperture is in fluid communication with the axial side of the second piston toward the body forward end. A pair of second fluid ports are provided to selectively communicate pressurized fluid to the opposing axial sides of the second piston. Means are provided for attachment of the external device to the second member at the second member forward end, with the external device fluid port in fluid communication with the end opening of the device drive aperture.

A plurality of elongated fluid conductors have a rearward end portion positioned in the first member recess and a forward end portion extending forward of the rearward wall into the second member apertures. The conducts extend into the second member apertures a sufficient axial distance to maintain the conductors positioned at least partially within the second member apertures as the second member axially reciprocates within the first member chamber between an end limit of travel toward the body forward end and an end limit of travel toward the body rearward end. The second member is axially movable relative to the conductor forward end portions for reciprocal axial movement relative to the first member. Each of the conductors has a longitudinally extending interior fluid conduit for communicating pressurized fluid between a rearward end portion of the conduit at the conductor rearward end portion and a forward end portion of the conduit at the conductor forward end portion, with the conduit forward end portion positioned to remain in fluid communication with one of second member apertures in which the conductor extends during the entire axial travel of the second member between its end limits of travel. The conduit rearward end portion of the one of the conductors extending into the piston drive apertures is in fluid communication with one of the pair of second fluid ports, to thereby communicate pressurized fluid to the axial side of the second piston toward the body forward end.

Seal means are included for providing a fluid-tight seal between the conductor forward end portions at a location intermediate the conduit forward and rearward end portions, and the second member apertures in which said conductors extend. Means are also provided for restraining the second member against rotational movement relative to the first member while permitting axial movement of the second member relative to the first member.

At least one third fluid port is provided to selectively communicate pressurized fluid to the conduit rearward end portion of the one of the conductors extending into the device drive aperture with the end opening, to thereby communicate pressurized fluid to the external device fluid port.

With the present invention, the external device can be selectively, rotationally moved relative to the body by selected rotation of the body, and selectively, linearly moved relative to the body by selected axial movement of the second member relative to the first member. Further, the external device, at the various positions to which moved, can be selectively and remotely operated under fluid-power by the selected application of pressurized fluid to the third fluid port.

Other features and advantages of the invention will become apparent from the following detailed description, taken in conjunction with accompanying drawings.

BRIEF DESCRIPTION OF THE DRAWINGS

FIG. 6 is an enlarged, fragmentary, sectional view of the actuator of FIG. 5 with the free piston in an intermediate position traveling to a forwardmost position.

FIG. 7 is an enlarged, fragmentary, sectional view of the actuator of FIG. 5 with the floating piston in a forwardmost position

BEST MODE FOR CARRYING OUT THE INVENTION

Figure 1:
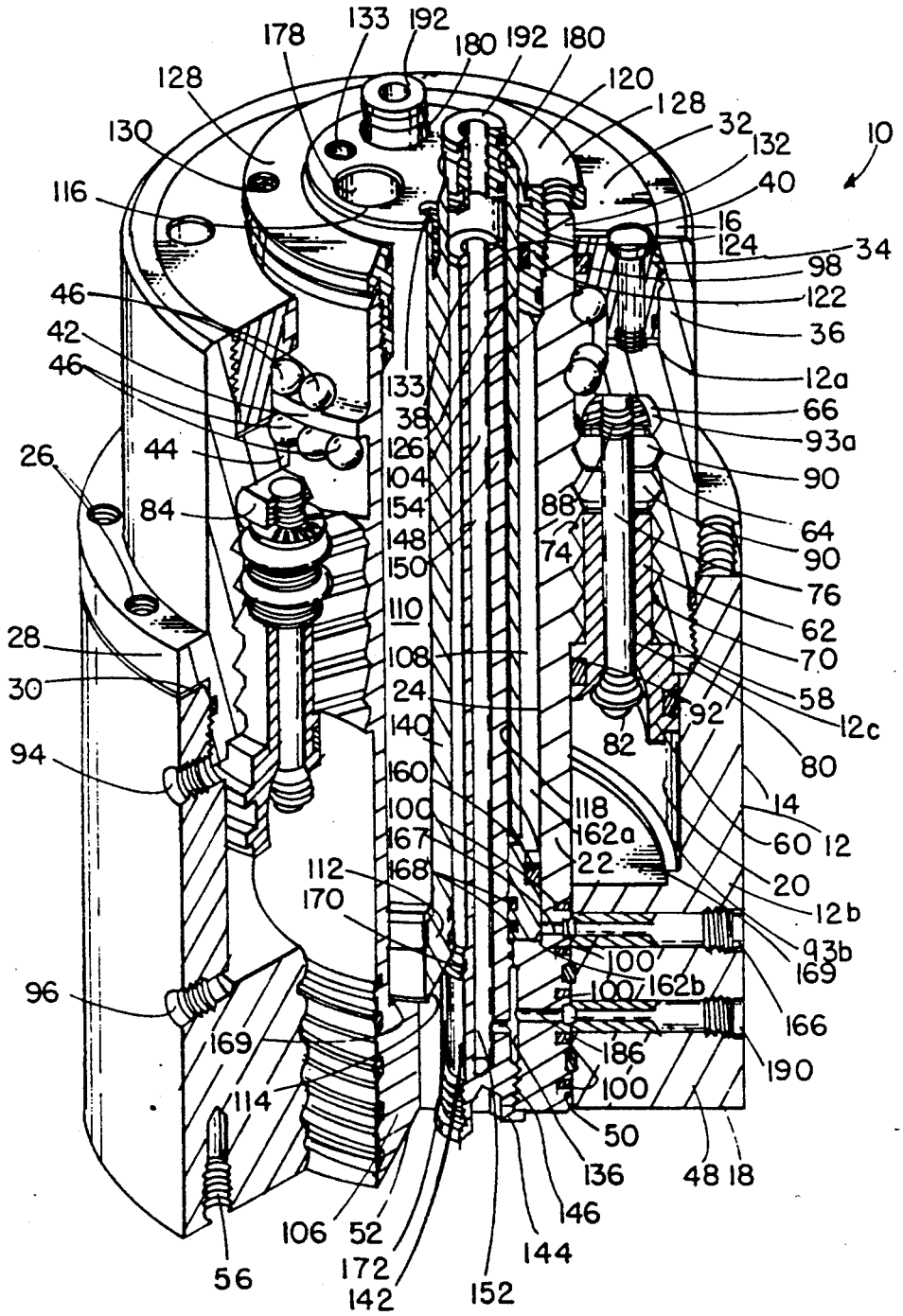
FIG. 1 is an isometric, sectional view of a fluid-powered roller actuator embodying the present invention.

As shown in the drawings for purposes of illustration, the present invention is embodied in a fluid-powered actuator, indicated generally by the reference numeral 10. A first embodiment of the actuator 10 is shown in FIGS. 1 through 4. The actuator 10 includes an elongated housing or body 12 having a generally cylindrical sidewall 14 and forward and rearward ends 16 and 18, respectively. The body 12 defines an interior body chamber 20 therein extending between the body forward and rearward ends 16 and 18. An elongated shaft 22 having a hollow center bore 24 is coaxially positioned within the body 12 and extends through the body chamber 20 between said body forward and rearward ends 16 and 18. The shaft 22 is supported by the body 12 for rotation relative to the body.

The body 12 is comprised of a forward body portion 12*a* and a rearward body portion 12*b* threadably connected together at a central threaded portion 12*c* of each body portion to permit selected adjustable rotation of the body portions relative to each other in order to set the end limits of rotation of the shaft 22 relative to the body and hence also to any device being rotated by the actuator 10. The threaded connection of the forward and rearward body portions 12*a* and 12*b* also allow the setting of a desired stroke length distance for a torque-transmitting piston sleeve. A plurality of set screws 26 are threaded into a radially outward extending flange 28 of the forward body portion 12*a* and are adjustable to engage a forward facing end wall 30 of the rearward body portion 12*b* to hold the forward and rearward body portions locked stationary with respect to each other during fluid-powered operation of the actuator 10.

An annular forward end cap 32 is positioned at the body forward end 16 and has an exteriorly threaded outer perimeter portion 34 threadably attached to an exteriorly threaded end portion 36 of the body 12. The forward end cap 32 has a central aperture 38 sized to receive therein an axially outward extending, forward end portion 40 of the shaft 22. The shaft 22 has a radially outward extending flange portion 42 positioned toward the body forward end 16 between the end cap 32 and a stop shoulder 44 in the body 12. The shaft 22 is rotatably held in place against axial thrust by thrust bearings 46 disposed between the shaft flange portion 42 and the stop shoulder 44 and between the shaft flange portion and the end cap 32.

The body 12 has an annular wall 48 at the body rearward end 18 with central aperture 50 sized to receive therein an axially outward extending, rearward end portion 52 of the shaft 22. The shaft 22 is rotatably disposed in the central aperture 38 of the forward end cap 32 and the central aperture 50 of the annular wall 48.

The body 12 is adapted for attachment to a stationary mounting base or support frame 54, by a plurality of threaded recesses 56 circumferentially spaced apart about an exterior face of the body annular wall 48.

An annular piston sleeve 58 is coaxially and reciprocally mounted within the body 12 coaxially about the shaft 22. The piston sleeve 58 has a head portion 60 positioned toward the body rearward end 18, and a cylindrical sleeve portion 62 fixedly attached to the head portion and extending axially therefrom toward the body forward end 16. The sleeve portion 62 of the piston sleeve 58 supports a plurality of freely rotatable rollers 64 disposed in a circumferential annular space 66 between the shaft 22 and the body sidewall 14. An inward facing surface portion 68 of the forward body portion 12*a*, toward the body forward end 16, has cut therein a plurality of helical grooves 70, and an outward facing surface portion 72 of the shaft 22 has cut therein a plurality of helical grooves 74. The helical body and shaft grooves 70 and 74 extend about the forward body portion 12*a* and the shaft 22, respectively, and have substantially the same axial pitch but are of opposite hand or turn. It is necessary to form the helical body grooves 70 on the forward body portion 12*a* which is not fixed to the mounting base 54, rather than on the rearward body portion 12*b*, in order to achieve adjustability of the end limits of rotation of the shaft 22 by rotation of the one body portion relative to the other.

The rollers 64 are disposed in a circumferentially aligned row in the circumferential space 66 between the grooved body portion 68 and the grooved shaft portion 72 and transmit force therebetween. The rollers 64 are rotatably retained in fixed axial and circumferential position relative to the piston sleeve 58 as the piston sleeve reciprocates within the body 12 during fluid-powered operation of the actuator 10 by a plurality of cylindrical shaft spindles 76. Each of the spindles 76 has a coaxially extending and integrally formed support arm portion 78 disposed in one of a plurality of bore holes 80 formed in the piston sleeve 58. The bore holes 80 are evenly circumferentially spaced apart about the piston sleeve 58 and axially extending fully through the sleeve portion 62 and the head portion 60 in the piston sleeve. The support arm portion 78 has a head 82 (at the rearward side of the head portion 60).

At the body forward end 16, the spindles 76 project into the circumferential space 66 between the body sidewall 14 and the shaft 22 and hold the rollers 64 restrained against axial movement relative to the spindles for rotation about the spindles on axes in parallel axial alignment with the body 12 In alternative constructions, the spindles may be designed to hold the rollers at a skewed angle.

The spindles 76 retain the rollers 64 in circumferentially distributed, spaced apart positions about the shaft 22 and within the circumferential space 66, with each of the rollers being in seated engagement and coacting with the helical body grooves 70 and the helical shaft grooves 74 for transmitting force between the body 12, the shaft 22 and the piston sleeve 58. Each ridge of the rollers 64 is positioned for rolling travel in corresponding grooves of both the helical body grooves 70 and the helical shaft grooves 74, and the corresponding ridges of adjacent rollers are axially positioned in generally the same plane or may be axially offset from one another, if desired.

Each of the spindles 76 has one of the rollers 64 coaxially and rotatably retained thereon. The rollers 64 each have a longitudinally extending coaxial roller bore for rotatably receiving a smooth surface end portion of the spindles 76 projecting outward beyond the forward end of the sleeve portion 62 of the piston sleeve 58. The roller 64 is held in place on the spindle 76 by an annular spindle support plate 84. The support plate 84 has a plurality of circumferentially spaced-apart threaded holes 86 arranged so each threadably receives a threaded free end portion 88 of one of the spindles therein. In the illustrated embodiment of the invention, each of the rollers 64 comprises two annular roller disks 90 independently and rotatably disposed on the spindle 76 in juxtaposition.

The head portion 60 of the piston sleeve 58 carries conventional seals 92, disposed between the head portion and a corresponding interior smooth wall portion of the body sidewall 14 to define fluid-tight compartments 93*a* and 93*b* to each side of the head portion toward the body forward end 16 and the body rearward end 18, respectively. Reciprocation of the piston sleeve 58 within the body chamber 20 occurs when hydraulic fluid or air under pressure selectively enters through one or the other of fluid ports 94 and 96 located in the sidewall 14 which communicate with the fluid-tight compartments 93*a* and 93*b*, respectively. Conventional seals 98 are disposed between the forward end cap 32 and the body sidewall 14, and between the forward end cap and the shaft 22 to prevent fluid leakage from the compartments. A plurality of seal glands 100 disposed between the body annular wall 48 and the shaft rearward end portion 52 serve to prevent fluid leakage from the compartment 93*b* at the body rearward end and, as will be described in more detail below, also to transmit pressurized fluid for other purposes.

The application of fluid pressure to the fluid-tight compartment 93*a* produces axial movement of the piston sleeve 58 toward the body rearward end 18, and the application of fluid pressure to the other fluid-tight compartment 93*b* produces axial movement of the piston sleeve toward the body forward end 16. The actuator 10 provides relative rotational movement between the body 12 and the shaft 22 through the conversion of linear movement of the piston sleeve 58 into rotational movement of the shaft.

The linear reciprocation of the piston sleeve 58 produces rotation of the piston sleeve and the shaft 22 through the force-transmitting capability of the rollers 64. As the piston sleeve 58 linearly reciprocates between one or the other axial directions within the body chambers 20 through alternatively applying fluid pressure to the compartments 93*a* and 93*b*, torque is transmitted by the rollers 64 to the piston sleeve through their coaction with the helical body grooves 70. The axial force created by fluid pressure on the head portion 60 causes the rollers 64 to roll along the helical body grooves 70 and transmit torque to the piston sleeve 58. The transmitted torque causes the piston sleeve 58 to rotate as it moves axially. By way of example, if the helical body grooves 70 are left hand, the piston sleeve 58 rotates counterclockwise when viewed from the body forward end 16 as the piston sleeve moves from the body forward end to the body rearward end 18 when fluid pressure is applied to the compartment 93*a* through the fluid port 94. As the piston sleeve 58 rotates counterclockwise, the rollers 64 roll along the helical body grooves 70 and themselves rotate clockwise.

The resulting linear and rotational movement of the piston sleeve 58 transmits both axial and rotational force to the shaft 22 through the coaction of the rollers 64 with the helical shaft grooves 74. The transmitted force causes the shaft 22 to rotate relative to the body 12 since axial movement of the shaft is restricted by the thrust bearings 46. A such, axial movement of the piston sleeve 58 produced by fluid pressure is converted into relative rotational movement between the body 12 and the shaft 22.

Continuing the example discussed above, if the helical shaft grooves 74 are right hand, the axial movement of the piston sleeve 58 toward the body rearward end 18 causes the shaft 22 to rotate counterclockwise relative to the piston sleeve. As the shaft 22 rotates counterclockwise, the rollers 64 roll along the helical shaft grooves 74 with a clockwise rotation. Since this is the same roller rotation as caused by the rollers rolling along the helical body grooves 70, no scuffing or slippage of the rollers occurs and the advantage of rolling friction rather than sliding friction is enjoyed. As noted above, since both the piston sleeve 58 and the shaft 22 rotate counterclockwise in response to the application of fluid pressure to the compartment 93*a*, the resulting relative rotation between the body 12 and the shaft is the sum of the rotation of the piston sleeve relative to the body and the rotation of the shaft relative to the piston sleeve.

It is noted that the rotational directions described above are merely reversed when the piston sleeve 50 moves from the body rearward end 18 to the body forward end 16 when fluid pressure is applied to the compartment 93*b* through the fluid port 96.

The actuator 10 is provided with means for eliminating backlash in the force-transmitting parts and for axially preloading of the piston sleeve 58 and the rollers 64. Backlash results from the slack or free movement between the force-transmitting parts of the actuator. The slack is usually due to the sizing of the grooves of the body 12 and shaft 22, and the rollers 64 positioned therein, which transmit force between the body and the shaft through the reciprocation of the piston sleeve 58. Backlash occurs as the piston sleeve 58 moves from one axial direction to the other within the body 12 as it reciprocates.

As previously described, each of the spindles 76 has one roller 64 rotatably mounted thereon, and each roller is comprised of two roller disks 90. To provide for backlash elimination and preloading, the roller disks 90 are sized to produce an adjustment space between the two roller disks when installed on the spindle 76 and positioned within the body 12 with the shaft 22 and piston sleeve 58 in place. This adjustment space allows for sufficient axial movement of the roller disks 90 toward each other to firmly engage between the two roller disks one of the ridge portions of the helical body grooves 70 and one of the ridge portions of the helical shaft grooves 74.

The two roller disks 90 of the roller 64 are selectively and adjustably moved toward each other by adjustably turning the spindle 76 carrying the two roller disks using a hexagonal head tool inserted into a hexagonal recess 102 in the spindle support arm head 82 prior to fluid-powered operation of the actuator 10. By so adjustably turning the spindle support arm head 82, the support plate 84 is drawn toward the body rearward end 18 and the two roller disks 90 of the roller 64 being adjusted are caused to be moved together and clamp therebetween the ridge portions of the corresponding helical body and shaft grooves 70 and 74.

In alternative embodiments not illustrated, the rollers used for transmitting torque can be replaced with conventional splines or ball races with balls disposed therein. In yet another alternative embodiment not illustrated, the piston sleeve 58 used to create rotation of the shaft 22 relative to the body 12 can be replaced with one or more vanes attached to the shaft for selected rotation of the shaft or any other fluid-powered means to rotate the shaft.

As described above, the shaft 22 has a hollow center bore 24. The shaft bore 24 has an open end 104 at the shaft forward end portion 40 and a rearward end wall 106 at the shaft rearward end portion 52 to define an interior shaft chamber 108 therein with one end opening. The shaft chamber 108 extends longitudinally and coaxially through the shaft 22 from the shaft end wall 106 fully through to the shaft forward end portion 40 and terminates with the open end 104.

An elongated second piston 110 is coaxially positioned in the shaft chamber 108 and is supported by the shaft 22 for axial movement relative to the shaft, and hence the body 12. The second piston 110 has a head portion 112 positioned at a rearward end 114 of the second piston toward the shaft end wall 106, and projects forwardly through the shaft open end 104 to a forward end 116 of the second piston. Three circumferentially spaced-apart bores 118 extend axially through the second piston 110 from the second piston rearward end 114 to the second piston forward end 116.

An annular forward end cap 120 is positioned at the shaft forward end portion 40 and has an exteriorly threaded perimeter portion 122 threadably attached to an interiorly threaded end portion 124 of the shaft forward end portion. The forward end cap 122 has a smooth-walled central aperture 126 sized to receive therein the second piston 110, and a radially outward extending flange 128. A plurality of set screws 130 are threaded into the flange 28 and are adjustable to engage a forward facing end wall 132 of the shaft 22 to hold the forward end cap 120 locked stationary with respect to the shaft during fluid-powered operation of the actuator 10.

The second piston 110 extends through and beyond the forward end cap 120 and terminates at the second piston forward end 116 to which a fluid-powered external device, such as a tool changer 134 can be rigidly attached for rotational and longitudinal movement with the second piston, as will be described in more detail below. As best shown in FIG. 1, the second piston forward end 116 has a plurality of threaded recesses 133 circumferentially spaced apart by which the tool changer 134 is attached to the second piston 110.

In the illustrated embodiment of the invention, the shaft end wall 106 has three circumferentially spaced apart bores 136 longitudinally extending fully therethrough. The second piston bores 118 are in coaxial alignment with the shaft end wall bores 136 to define aligned pairs of shaft end wall and second piston bores. The actuator 10 includes three rigid fluid transfer tubes 140, with one tube being disposed within each of the three corresponding pairs of aligned shaft end wall and second piston bores 136 and 138.

Figure 2:
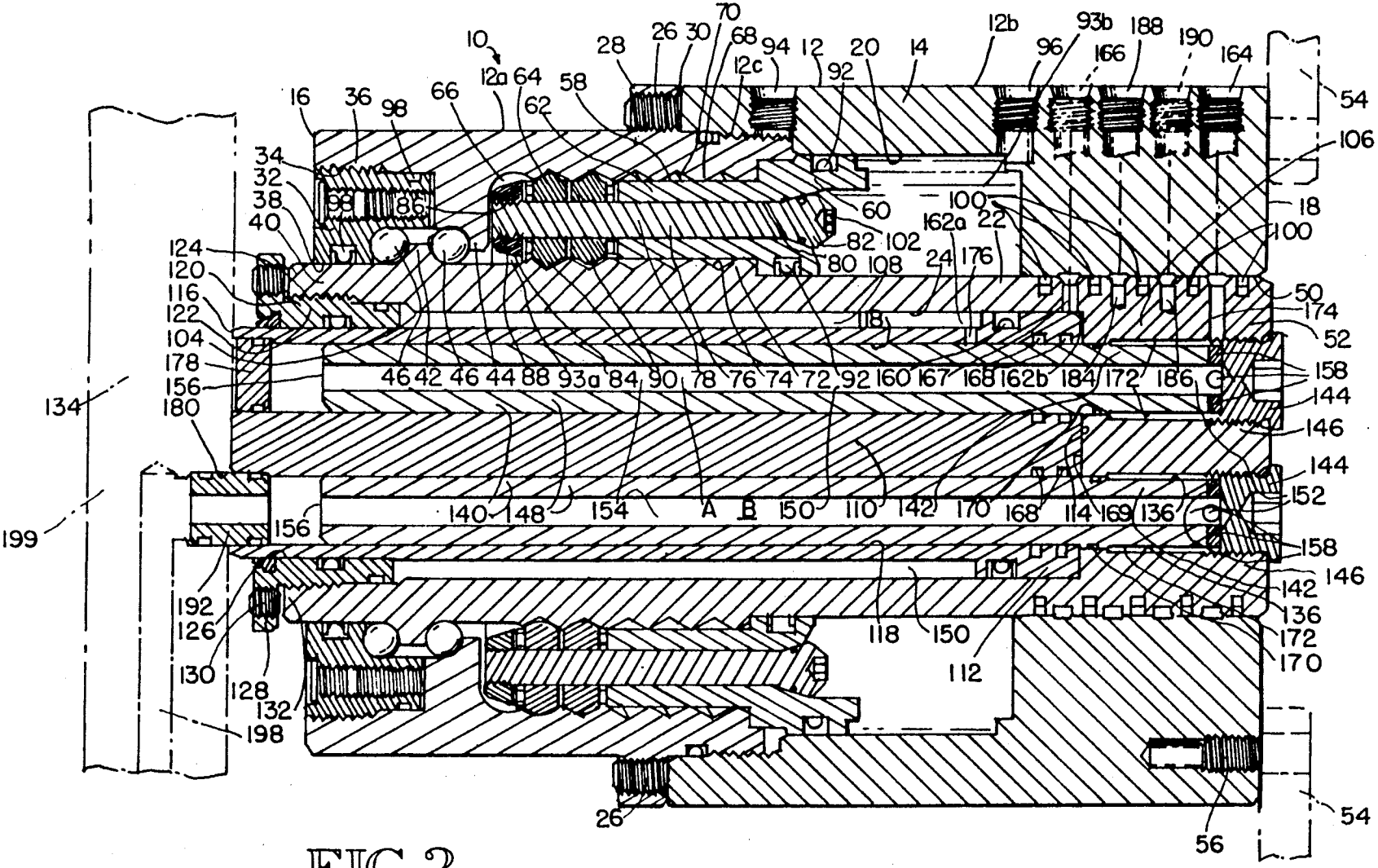
FIG. 2 is a side elevational, sectional view of the actuator of FIG. 1.

The tubes 140 each have a rearward end portion 142 toward the body rearward end 18 fixedly retained in position within one of the shaft end wall bores 136 by an exteriorly threaded tube end cap 144 formed integral with the tube. The tube end cap 144 is threadably received in an interiorly threaded portion 146 of the shaft end wall bore 136. The tubes 140 further have a forward end portion 148 extending forward from the shaft end wall 106 into t he second piston bores 118 a sufficient axial distance to maintain the tubes positioned at least partially therein as the second piston 110 axially reciprocates within the shaft chamber 108 between an end limit of axial travel toward the body forward end 16 and an end limit of travel toward the body rearward end 18. The second piston 110 is shown in FIG. 2 at its end limit of axial travel toward the body rearward end 18.

The second piston 110 is slidably disposed on the tube forward end portions 148 for reciprocal axial movement relative to the shaft 22, but is restrained against rotating relative to the shaft by the tubes 140 in response to any torque that is applied to the second piston. The inside diameter of the second piston bores 118 and the outside diameter of the tubes 140 are closely matched to provide a snug fit but to allow sufficient clearance so as not to inhibit smooth and free sliding of the second piston 110 on the tube forward end portions 148.

Each of the tubes 140 has a longitudinally extending, interior fluid conduit 150 for communicating pressurized fluid between a rearward end portion 152 of the conduit at the tube rearward end portion 142 and a forward end portion 154 of the conduit at the tube forward end portion 148. The conduit forward end portion 154 terminates in an open end, located toward the body forward end 16, which is in fluid communication with the second piston bore 118 into which the tube 140 extends, and the conduit forward end portion remains in fluid communication therewith during the entire axial travel of the second piston 110 between its axial end limits of travel. The conduit rearward end portion 152 is in fluid communication with the shaft end wall bore 136 into which the tube 140 extends through a plurality of apertures 158 in the wall of the tube.

The second piston head portion 112 carries a conventional seal 160, disposed between the head portion and a corresponding interior smooth wall portion of the shaft chamber 108 to define fluid-tight compartments **162*a* and 162*b* to each side of the head portion toward the body forward end 16 and the body rearward end 18, respectively. Reciprocation of the second piston 110 within the shaft chamber 108 occurs when hydraulic fluid or air under pressure selectively enters through one or the other of fluid ports 164 and 166 located in the body annular wall 48 which communicates with the fluid-tight compartments 162*a* and 162b, respectively. A passageway 167 extending through the shaft end wall 106 communicates fluid between the fluid port 166 and the compartment 162*b*. The manner of communicating fluid between the fluid port 164 and the chamber 162*a* will be described below. Application of fluid pressure to fluid port 164 causes the second piston 110 to retract rearwardly into the shaft chamber 108, and application of fluid pressure to the fluid port 166 causes the second piston to extend forwardly from the shaft chamber and thus linearly move the second piston and the tool changer 134 attached thereto Conventional seals 168 are carried by the second piston 110 inward of the second piston head portion 112 within each of the second piston bores 118, disposed between the second piston and the tube 140 extending into the second piston bore. A conventional seal 170 is carried by the tube rearward end portion 142 of each tube 140, disposed between the tube and the shaft end wall 106 inward from a forward face 169 of the shaft end wall toward the body forward end 16**.

A lengthwise portion of the shaft end wall bore 136 on a side of the seal 170 toward the body rearward end 18 has an inside diameter greater than the outside diameter of the tubes 140 to define an annular fluid chamber 172 about the tube rearward end portion 142. The annular fluid chamber 172 is in fluid communication with the tube conduit 150 of the tube 140 extending into the shaft end wall bore, through the apertures 158 provided in the tube wall.

The shaft end wall annular chamber 172 associated with the tube 140 with the letter designation "A" in FIG. 2 is in fluid communication with the port 164 through a passageway 174 extending through the shaft end wall 106. As noted above, the selective application of pressurized fluid to fluid port 164 communicates fluid to the compartment **162*a* to cause the second piston 110 to move toward the body rearward end 18 to retract the second piston into the shaft chamber 108. The fluid is passed through the open end 156 of the conduit 150 of the tube 140 designated "A", to the second piston bore 118 into which the tube extends, and then through an aperture 176 in the wall of the second piston 110 communicating with the shaft chamber 108. A forward end of the second piston bore 118 into which the tube 140** designated "A" extends at the second piston forward end 116 is blocked by a sealing plug 178. With this arrangement, one of the tubes 140 is conveniently utilized to transmit fluid pressure to the side of the second piston head portion 112 toward the body forward end 16.

The other two tubes 140, of which only one can be seen in FIG. 2 and has the letter designation "B", transmit fluid pressure to a pair of fluid ports 180 for the tool changer 134 (only one of these ports can be seen in FIG. 2). In similar fashion as described above, the shaft end wall annular chambers 172 associated with the shaft end wall bores 136 into which the other two tubes 140 extend, each have a passageway 184 and 186 extending through the shaft end wall 106 to communicate fluid with a corresponding one of a pair of fluid ports 188 and 190, respectively, located in the body annular wall 48. The fluid ports 188 and 190 are used to selectively and remotely operate the tool changer 134, as will be described in more detail below. The seal glands 100 provide fluid separation between the passageways 167, 174, 184 and 186 at the interface of the shaft end wall 106 and the body annular wall 48 as the shaft 12 rotates relative to the body 12.

With the two tubes 140 which provide fluid drive to the tool changer 134, the forward end of the second piston bores 118 at the second piston forward end 116, into which the tubes extend, are left open. These two forward ends are aligned with the corresponding two fluid ports 180 of the tool changer 134 for fluid communication therebetween. A fluid coupler 192 projects into each of these two forward ends and the corresponding two fluid ports 180 of the tool changer 134 to facilitate a tight seal therebetween and prevent fluid leakage.

It is noted that with the actuator 10 of the present invention, the tool changer 134 is carried at the second piston forward end 116 and selectively, rotationally moved relative to the body 12 by selected rotation of the shaft 22, and selectively, linearly moved relative to the body by selected axial movement of the second piston 110 relative to the shaft. Further, the tool changer 134 can be selectively and remotely operated under fluid-power at the various positions to which moved by the selected application of fluid pressure to the fluid ports 188 and 190 in the body annular wall 48. The result is a high torque, efficient tool changer actuator 10 with a very compact design and having a very short axial length. The actuator 10 is relatively simple in construction, reliable and inexpensive relative to many existing tool changer actuators for which the present invention can be substituted. No fluid hoses need be connected directly to the tool changer.

Figure 3:
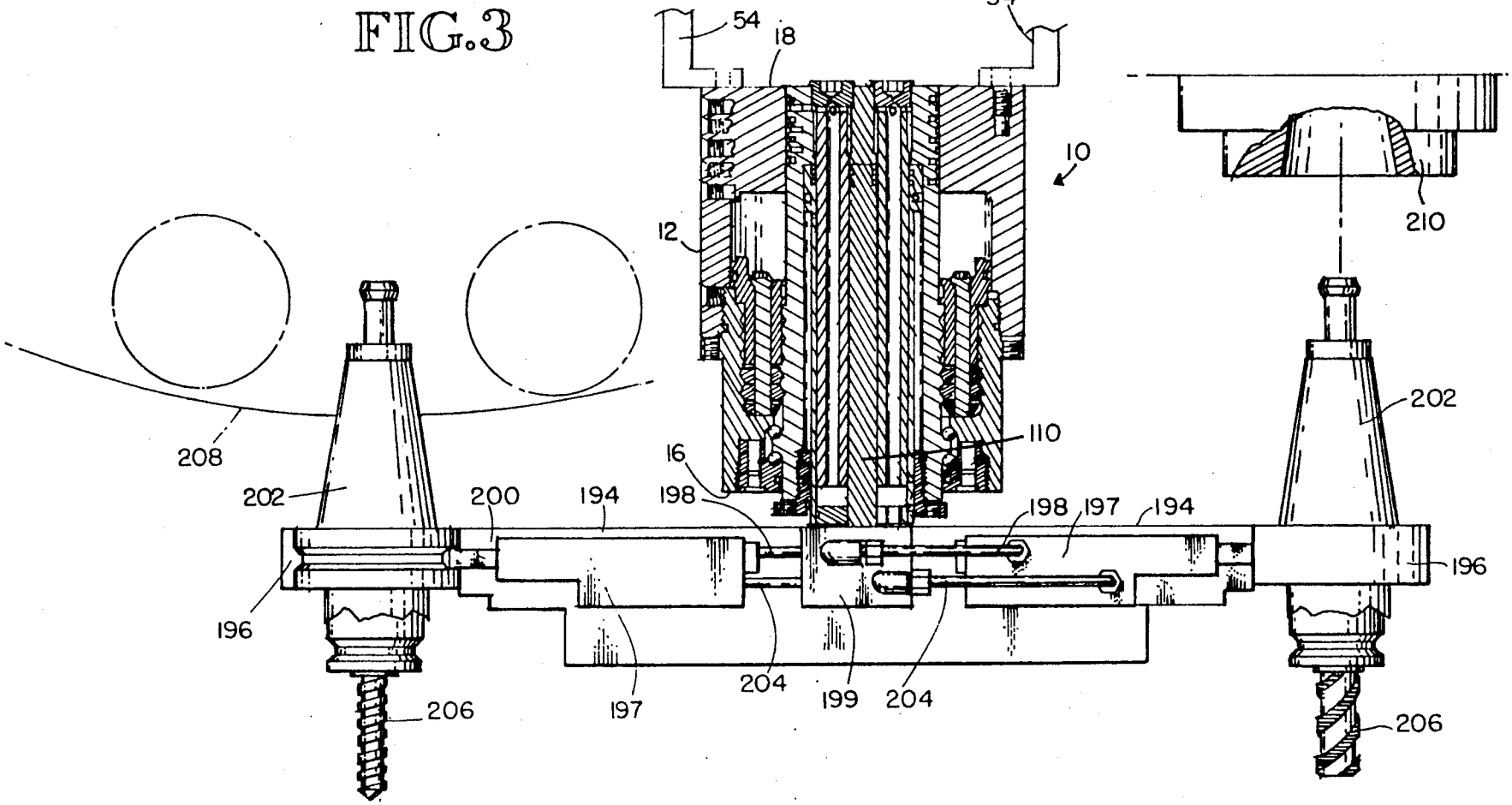
FIG. 3 is a side elevational view of the actuator as shown in FIG. 2, showing a fluid-powered tool changer with dual gripper arms attached thereto and holding two tools, and showing a tool carousel in phantom line and a machine working spindle.
Figure 4:
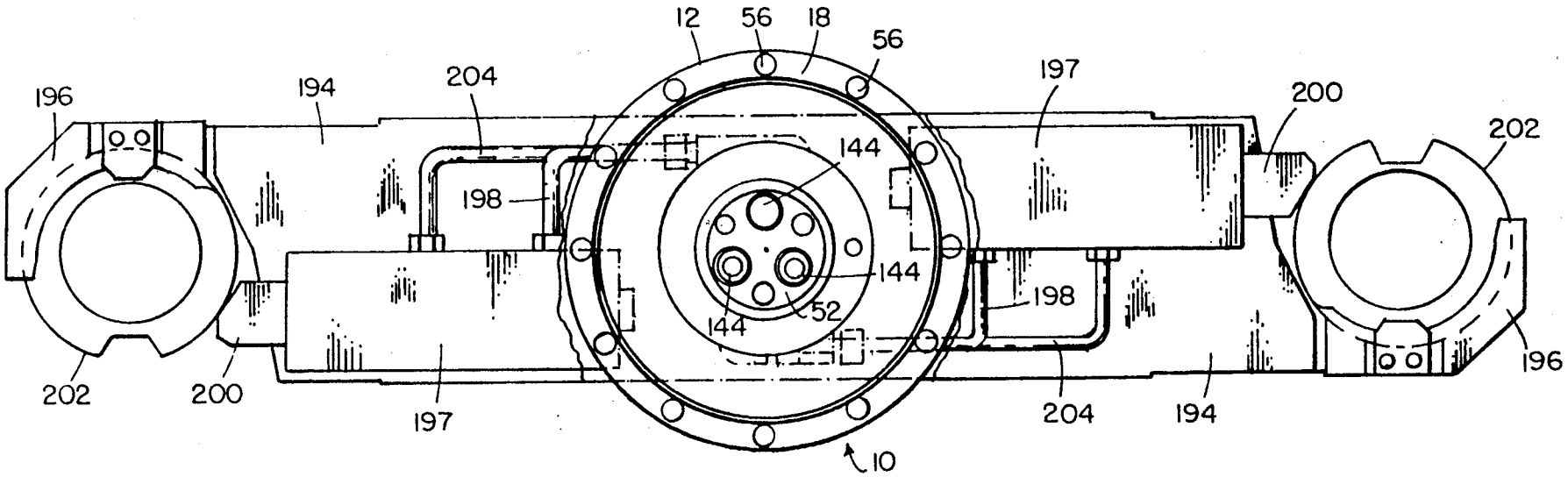
FIG. 4 is a rear view of the actuator and tool changer of FIG. 3.

As best shown in FIGS. 3 and 4, the tool changer 134 shown for purposes of illustration, is of a conventional design using a pair of gripper arms 194 rigidly connected together at an inner end in longitudinal alignment. A fluid-powered tool gripper 196 is provided at a distal end of each arm and is actuated by a fluid-powered gripper actuator 197. Each of the gripper actuators 197 is in fluid communication with both of the two tool changer fluid ports 180 to provide for simultaneous operation of both grippers by the application of fluid pressure to one or the other of the fluid ports 180. A pair of fluid tubes 198 are connected between one of the fluid ports 180 via a manifold 199 and the gripper actuators 197 to cause a finger 200 of both grippers 196 to simultaneously retract and thereby allow the grippers to be positioned about a tool holder 202 of conventional design, if not already grasping a tool holder, or to release the tool holder, if already grasping the tool holder. Another pair of fluid tubes 204 are connected between the other one of the fluid ports 180 via the manifold 199 and the gripper actuators 197 to cause the finger 200 of both grippers 196 to simultaneously extend and thereby grasp the tool holders 202 if the grippers have been moved into position about the tool holders by the actuator 10. Although each of the tool holders 202 is of standard size, a variety of styles and sizes of tools 206 may be held by the tool holder. By the application of fluid pressure to the fluid ports 188 and 190 in the body annular wall 48, the grippers 196 can be selectively and remotely provided with fluid-drive.

As previously described, the tool changer 134 is rigidly attached to the second piston 110 at its forward end 116 using the threaded recesses 133 and a plurality of fasteners (not shown), for rotational and longitudinal movement with the second piston. In such manner, the selective application of fluid pressure fluid to the fluid ports 94 and 96 in the body sidewall 14 control rotation of the tool changer 134 relative to the body 12 about the axis of the shaft 22 by causing rotation of the shaft relative to the body. The selective application of pressurized fluid to the fluid ports 164 and 166 in the body annular wall 48 control linear movement of the tool changer 134 relative to the body 12 along the axis of the second piston 110 by causing the longitudinal movement of the second piston relative to the shaft 22. The controlled motion the actuator 10 thereby provides for the tool changer 134 is used to move the tool changer about and place the grippers 196 at desired positions relative to a tool magazine or carousel 208 of conventional design in which tools 206 in tool holders 202 are stored, and relative to a machining work spindle 210 which turns and positions the tool relative to a work piece (not shown) being machined.

While the illustrated tool changer 134 has only two fluid ports 180 for the simultaneous operation of the grippers 196, the actuator 10 of the present invention can be used with other tool changers requiring more fluid ports, as is necessary to provide independent gripper actuation, by the use of additional second piston bores 118 and tubes 140. Of course, the actuator 10 is also usable with a tool changer which requires only a single fluid port to fluid drive the grippers to an open or closed position and utilizes springs to return the grippers to the other position.

Figure 5:
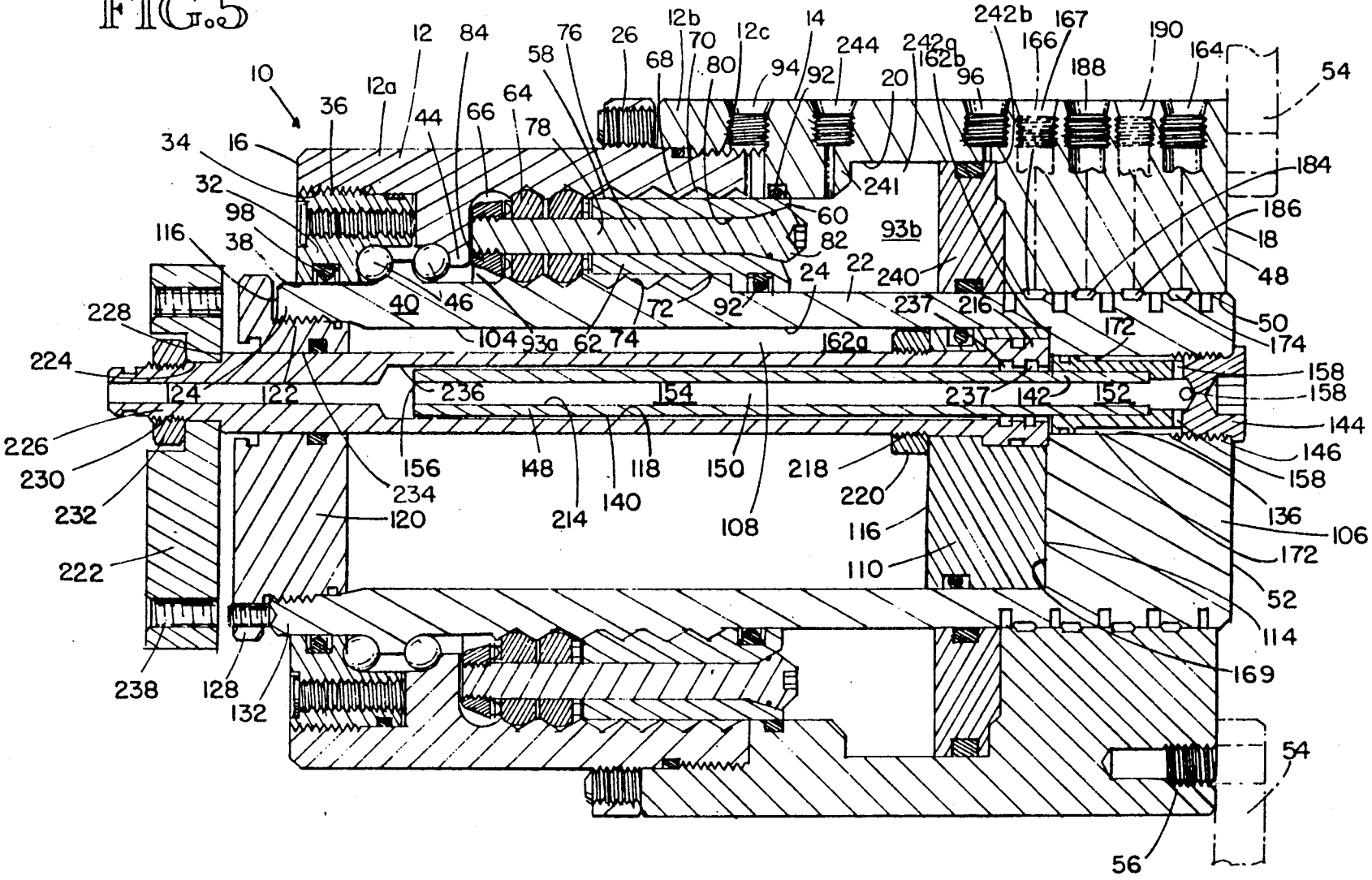
FIG. 5 is a side elevational, sectional view of an alternative embodiment of the actuator of FIG. 1, showing torque rods and a free piston in a rearwardmost position.

An alternative embodiment of the invention very similar to the embodiment of FIG. 1 is shown in FIGS. 5 through 7. For ease of understanding, the components of this alternative embodiment will be similarly numbered with those of the first embodiment when of a similar construction. Only the differences in construction will be described in detail. In this alternative embodiment, instead of utilizing the fluid transfer tubes 140 to restrain the second piston 110 against rotational movement relative to the shaft 22, three circumferentially spaced apart torque rods 214 are used and comprise part of an axially reciprocating second piston assembly. For clarity, only one torque rod is shown in FIG. 5. In this piston assembly the second piston 110 is much shorter in length than in the first embodiment and is positioned toward the shaft end wall 106 of the shaft chamber 108. The torque rods 214 extend through the second piston bores 118 and are fixedly attached to the second piston 110 for axial travel therewith. Each of the torque rods 214 has a head portion 216 at a rearward end thereof and an exteriorly threaded portion 218 adjacent to the second piston forward end 116. A lock nut 220 is threadably received on the torque rod threaded portion 218 to securely lock the second piston 110 between the torque rod head portion 216 and the nut 220 for axial travel of the torque rods and second piston as a unit.

The piston assembly also includes an end plate 22 having three circumferentially spaced apart bores 224 extending therethrough. A reduced diameter forward end portion 226 of the torque rods 214 projects through the end plate bores 224 to securely hold the desired torque rod interspacing and provide rigidity to the piston assembly. The torque rod reduced diameter portion 226 defines a forwardly facing stop shoulder 228 against which a rearward face of the end plate 222 is positioned. An exteriorly threaded portion 230 of the torque rods 214, outward of a forward face of the end plate 222, threadably receives a lock nut 232 thereon to securely lock the end plate between the stop shoulder 228 and the lock nut 232.

In this second embodiment of FIG. 5, the forward end cap 120 has three circumferentially spaced apart apertures 234 which correspond to the desired torque rod interspacing, instead of the single central aperture 126 used for the first embodiment, and each slidably receives one of the torque rods 214 therein. Unlike the first embodiment where the fluid transfer tubes 140 serve dual functions and restrain the second piston 110 against rotation in addition to transferring fluid, in this second embodiment the forward end cap 120 is the primary restraint on the piston assembly against its rotation during fluid-powered operation of the actuator 10. This is accomplished by restraining each of the torque rods 214 against rotation while leaving them free to axially reciprocate with the second piston 110 As such, the fluid transfer tubes 140 need not be constructed with as great of strength and rigidity In this second embodiment, each of the tubes 140 extends into a smooth interior, lengthwise extending bore 236 in one of the torque rods 214, much as with the second piston bores 118 of the first embodiment. The rearward ends of the torque rod bores 236 carry conventional seals 237 within the bores, disposed between the torque rod and the tube 140 extending into the torque rod bore. The forward ends of the torque rod bores 236 may be sealed or left open to communicate fluid with the side of the second piston 110 toward the body forward end 16 to provide fluid drive to the second piston or with the fluid ports 180 of the tool changer 134. The tool changer 134 is rigidly attached to the piston assembly at the end plate 222 using a plurality of threaded attachment holes 238 in the end plate. The holes 238 also provide access to the set screws 130 of the forward end cap 120 when the tool changer 134 is not mounted to the actuator 10.

It is noted that in lieu of using torque rods 214 as the means to restrain the second piston 110 against rotation, an oval second piston head portion disposed in an oval shaft chamber may be used. Similarly, an oval piston and slide in an oval bearing, or a splined central torque rod positioned in a lengthwise extending splined aperture in the center of the second piston between the fluid transfer tubes, may be used. Another feature of the second embodiment of FIG. 5 is the use of a free annular piston 240 slidably disposed in the body chamber 20, between a body stop shoulder 241 toward the piston sleeve head portion 60 and the body annular wall 48. The free piston 240 divides the fluid-tight chamber **93*b* into two fluid-tight chambers 242*a* and 242*b*, and an additional fluid port 244 is provided in the body sidewall 14 to communicate fluid with the chamber 242*a* to a forward side of the free piston. The fluid port 96 communicates fluid with the chamber 242*b* to a rearward side of the free piston 240. By the selective application of pressurized fluid to the ports 96 and 244, the free piston is moved between its two positions and the length of the stroke of the piston sleeve 58, and hence the rotational end limits of the shaft 22, may be varied. The result is to provide the shaft 22 with three rotational stop positions achievable by selectively applying fluid pressure to the fluid ports 94, 96 and 244, rather than only the two stop positions provided by the first embodiment. As such, the shaft 22** can be selectively rotated between, for example, any of 0 degree, 90 degree or 180 degree positions.

This is best illustrated by the series of FIGS. 5 through 7. In FIG. 5, when the fluid port 244 is used to control the axial movement of the piston sleeve 58 and the fluid port 96 is left in an unpowered state so it can freely drain the first application of fluid pressure to the fluid port 244 will move the free piston 240 all the way to the body annular wall 48. A similar result is achieved by the first application of fluid pressure to the fluid port 94 by the piston sleeve 58 engaging and moving the free piston 240. The piston sleeve 58 is then able to travel from its end limit of axial travel shown in FIG. 5, which is one end rotational position of the shaft 22, the full length of its stroke toward the body rearward end 18 uninhibited by the free piston 240, which is another end rotational position of the shaft 22. When it is desired to reduce the length of the piston sleeve stroke, and hence set a third intermediate rotational position for the shaft 22, and third intermediate rotational position to which the tool changer 134 can be rotated, fluid pressure is applied to fluid port 96 to move the free piston 240 to the body stop shoulder 241, as shown in FIG. 7. FIG. 6 illustrates the free piston 240 traveling toward the body stop shoulder 241 under the influence of fluid pressure applied to fluid port 96. The fluid pressure applied to fluid port 96 must generate a higher force on the free piston 240 in the direction toward the body forward end 16 than created by the fluid pressure applied to the fluid port 94 to prevent motion of the free piston when pushed against by the piston sleeve in the direction toward the body rearward end 18, and thereby limit further movement of the piston sleeve toward the body rearward end. This is accomplished using a single pressure fluid supply as a result of the free piston 240 being sized larger than the piston sleeve head portion 60. The fluid force applied to the fluid port 96 must hold the free piston 240 in its position at body stop shoulder 241 when fluid is applied to fluid port 94 to axially move the piston sleeve 58 toward the body rearward end. When the free piston 240 is positioned at the body stop shoulder 241, the length of the piston sleeve stroke will be reduced since the piston sleeve 58 will engage and be stopped by the free piston when driven into contact with the free piston. The reduced stroke length results in a third intermediate rotational position for the shaft 22, and hence the tool changer 134 can be rotated between any one of three rotational positions, such as when it is desired to rotate the tool changer gripper 196 between positions at the work spindle 210, a first tool carousel, and a neutral position. This is accomplished simply by controlling the application of pressurized fluids to the three fluid ports 94, 96 and 244 in the body sidewall 14. Additional free pistons can be added adjacent to the free piston 240, with appropriate additional fluid ports, to create additional stop positions for the shaft 22.

It will be appreciated that, although specific embodiments of the invention have been described herein for purposes of illustration, various modifications may be made without departing from the spirit and scope of the invention. Accordingly, the invention is not limited except as by the appended claims.

What is claimed is:

1. A fluid-powered actuator for selectively rotating and linearly moving a fluid-powered external device with at least two fluid ports to communicate pressurized fluid thereto for the operation of the external device, comprising:

an outer generally cylindrical body having a forward end and a rearward end;

a shaft extending generally coaxially within said body and supported for rotational movement relative to said body, said shaft having a forward end toward said body forward end and a rearward end with a rearward wall toward said body rearward end, said rearward wall having at least three spaced apart bores extending longitudinally through said rearward wall from toward a face thereof toward said first member rearward end to and fully through a face thereof toward said first member forward end, said shaft further having a chamber extending longitudinally and generally coaxially through said shaft from said rearward wall fully through to said shaft forward end to define a chamber end opening at said shaft forward end;

an annular first piston mounted for reciprocal axial movement within said body in a response to the application of fluid pressure to one or the other opposing axial sides thereof, said first piston having a central aperture through which said shaft projects;

a pair of first fluid ports in said body to selectively communicate pressurized fluid to said opposing sides of said first piston;

first means for transmitting torque between said body and said shaft to produce rotational movement of said shaft relative to said body in response to axial movement of said first piston;

an elongated second piston extending generally coaxially within said shaft chamber and supported for axial movement relative to said shaft, said second piston projecting forwardly to said chamber end opening, and having a forward end and a rearward end with spaced apart bores extending generally longitudinally through said second piston from said second piston rearward end to a position toward said second piston forward end, said second piston bores including a piston drive bore having a closed end toward said second piston forward end, and at least two device drive bore extending fully through to said second piston forward end to define a pair of end openings at said second piston forward end, said second piston bores being in generally coaxial alignment with said shaft bores in said rearward wall, said second piston including an annular piston head portion mounted for reciprocal axial movement within said shaft chamber in response to the application of fluid pressure to one or the other opposing axial sides thereof to produce axial movement of said second piston relative to said shaft, said piston drive bore being in fluid communication with said axial side of said second piston head portion toward said body forward end; a pair of second fluid ports in said body to selectively communicate pressurized fluid to said opposing axial sides of said second piston head portion;

means for attachment of the external device to said second piston at said second piston forward end with the external device fluid ports in fluid communication with said end openings of said device drive bore;

a plurality of rigid tubes having a rearward end portion fixedly positioned in said shaft bores and a forward end portion extending forward of said rearward wall into said second piston bores a sufficient axial distance to maintain said tubes positioned at least partially within said second piston bores as said second piston axially reciprocates within said shaft chamber between an end limit of travel toward said body forward end and an end limit of travel toward said body rearward end, said second piston being slidably disposed on said tube forward end portions for reciprocal axial movement relative to said shaft, said tubes restraining said second piston against rotational movement relative to said shaft while permitting axial movement of said second piston relative to said shaft, each of said tubes having a longitudinally extending interior fluid conduit for communicating pressurized fluid between a rearward end portion of said conduit at said tube rearward end portion and a forward end portion of said conduit at said tube forward end portion, with said conduit forward end portion positioned to remain in fluid communication with the one of said second piston bores in which said tube extends during the entire axial travel of said second piston between said end limits of travel, said conduit rearward end portion of the one of said tubes extending into said piston drive bore being in fluid communication with one of said pair of second fluid ports, to thereby communicate pressurized fluid to said axial side of said second piston head portion toward said body forward end;

seals positioned to provide a fluid-tight seal between said tube forward end portion at a location intermediate said conduit forward and rearward end portions, and said second piston bores in which said tubes extend; and a pair of third fluid ports in said body to selectively communicate pressurized fluid to said conduit rearward end portion of the ones of said tubes extending into said device drive bores with said end openings, to thereby communicate pressurized fluid to the external device fluid ports, whereby the external device can be selectively, rotationally moved relative to said body by selected rotation of said shaft, and selectively, linearly moved relative to said body by selected axial movement of said second piston relative to said shaft, and the external device, at the various positions to which moved, can be selectively and remotely operated under fluid-power by the selected application of pressurized fluid to said third fluid ports in said body.

2. A fluid-powered actuator for selectively rotating and linearly moving a fluid-powered external device with at least one fluid port to communicate pressurized fluid thereto for the operation of the external device, comprising:

an outer generally cylindrical body having a forward end and a rearward end;

a first member extending generally coaxially within said body and supported for rotational movement relative to said body, said first member having a forward end toward said body forward end and a rearward end with a rearward wall toward said body rearward end, said rearward wall having a plurality of bores extending longitudinally through said rearward wall from toward a face thereof toward said first member rearward end to and fully through a face thereof toward said first member forward end, said first member further having a chamber extending longitudinally and generally coaxially through said first member from said rearward wall fully through to said first member forward end to define a chamber end opening at said first member forward end;

an annular first piston mounted for reciprocal axial movement within said body in a response to the application of fluid pressure to one or the other opposing axial sides thereof, said first piston having a central aperture through which said first member projects;

a pair of first fluid ports in said body to selectively communicate pressurized fluid to said opposing sides of said first piston;

first means for transmitting torque between said body and said first member to produce rotational movement of said first member relative to said body in response to axial movement of said first piston;

a second member extending generally coaxially within said first member chamber and supported for axial movement relative to said first member, said second member projecting forwardly to said chamber end opening, and having a forward end and a rearward end with a plurality of bores extending generally longitudinally through said second member from said second member rearward end to a position toward said second member forward end, said second member bores including a piston drive bore having a closed end toward said second member forward end, and at least one device drive bore extending fully through to said second member forward end to define an end opening at said second member forward end, said second member bores being in generally coaxial alignment with said first member bores in said rearward wall;

a second piston mounted for reciprocal axial movement within said first member chamber in response to the application of fluid pressure to one or the other opposing axial sides thereof, said second piston operatively engaging said second member to produce axial movement of said second member relative to said first member, said piston drive bore being in fluid communication with said axial side of said second piston toward said body forward end;

a pair of second fluid ports in said body to selectively communicate pressurized fluid to said opposing axial sides of said second piston;

means for attachment of the external device to said second member at said second member forward end with the external device fluid port in fluid communication with said end opening of said device drive bore;

a plurality of rigid tubes having a rearward end portion positioned in said first member bores and a forward end portion extending forward of said rearward wall into said second member bores a sufficient axial distance to maintain said tubes positioned at least partially within said second member bores as said second member axially reciprocates within said first member chamber between an end limit of travel toward said body forward end and an end limit of travel toward said body rearward end, said second member being slidably disposed on said tube forward end portions for reciprocal axial movement relative to said first member, said tubes restraining said second member against rotational movement relative to said first member while permitting axial movement of said second member relative to said first member, each of said tubes having a longitudinally extending interior fluid conduit for communicating pressurized fluid between a rearward end portion of said conduit at said tube rearward end portion and a forward end portion of said conduit at said tube forward end portion, with said conduit forward end portion positioned to remain in fluid communication with the one of said second member bores in which said tube extends during the entire axial travel of said second member between said end limits of travel, said conduit rearward end portion of the one of said tubes extending into said piston drive bore being in fluid communication with one of said pair of second fluid ports, to thereby communicate pressurized fluid to said axial side of said second piston toward said body forward end;

seals positioned to provide a fluid-tight seal between said tube forward end portions at a location between said conduit forward and rearward end portions, and said second member bores in which said tubes extend; and at least one third fluid port in said body to selectively communicate pressurized fluid to said conduit rearward end portion of the one of said tubes extending into said device drive bore with said end opening, to thereby communicate pressurized fluid to the external device fluid port, whereby the external device can be selectively, rotationally moved relative to said body by selected rotation of said first member, and selectively, linearly moved relative to said body by selected axial movement of said second member relative to said first member, and the external device, at the various positions to which moved, can be selectively and remotely operated under fluid-power by the selected application of pressurized fluid to said third fluid port in said body.

3. A fluid-powered actuator for selectively rotating and linearly moving a fluid-powered external device with at least two fluid port to communicate pressurized fluid thereto for the operation of the external device, comprising:

an outer generally cylindrical body having a forward end and a rearward end;

a shaft extending generally coaxially within said body and supported for rotational movement relative to said body, said shaft having a forward end toward said body forward end and a rearward end with a rearward wall toward said body rearward end, said rearward wall having at least three spaced apart bores extending longitudinally through said rearward wall from toward a face thereof toward said first member rearward end to and fully through a face thereof toward said first member forward end, said shaft further having a chamber extending longitudinally and generally coaxially through said shaft from said rearward wall fully through to said shaft forward end to define a chamber end opening at said shaft forward end; axial movement within said body in a response to the application of fluid pressure to one or the other opposing axial sides thereof, said first piston having a central aperture through which said shaft projects;

a pair of first fluid ports in said body to selectively communicate pressurized fluid to said opposing sides of said first piston;

first means for transmitting torque between said body and said shaft to produce rotational movement of said shaft relative to said body in response to axial movement of said first piston;

a piston assembly including a second piston and at least three spaced apart torque rods, said torque rods extending generally longitudinally within said shaft chamber and being fixedly connected to said second piston for axial travel therewith, said piston assembly being supported for axial movement relative to said shaft, said second piston being mounted for reciprocal axial movement within said shaft chamber in response to the application of fluid pressure to one or the other opposing axial sides thereof to produce axial movement of said piston assembly relative to said shaft, each of said torque rods projecting forwardly to said chamber end opening, and having a forward end and a rearward end with a bore extending generally axially through said torque rod from said torque rod rearward end to a position toward said torque rod forward end, one of said torque rod bores being a piston drive bore having a closed end toward said torque rod forward end and being in fluid communication with said axial side of said second piston toward said body forward end, and at least two of said torque rod bores being device drive bores, each extending fully through one of said torque rods to said torque rod forward end to define an end opening at said torque rod forward end, said torque rod bores being in generally coaxial alignment with said shaft bores in said rearward wall;

a pair of second fluid ports in said body to selectively communicate pressurized fluid to said opposing axial sides of said second piston;

means for attachment of the external device to said piston assembly at said torque rod forward end with the external device fluid ports in fluid communication with said end openings of said device drive bore;

a plurality of fluid conducting tubes, each said tube having a rearward end portion fixedly positioned in one of said shaft bores and a forward end portion extending forward of said rearward wall into one of said torque rod bores a sufficient axial distance to maintain said tube positioned at least partially within said torque rod bores as said piston assembly axially reciprocates within said shaft chamber between an end limit of travel toward said body forward end and an end limit of travel toward said body rearward end, said torque rods being axially movable relative to said tube forward end portions for reciprocal axial movement relative to said shaft, each of said tubes having a longitudinally extending interior fluid conduit for communicating pressurized fluid between a rearward end portion of said conduit at said tube rearward end portion and a forward end portion of said conduit at said tube forward end portion, with said conduit forward end portion positioned to remain in fluid communication with the one of said torque rod bores in which said tube extends during the entire axial travel of said piston assembly between said end limits of travel, said conduit rearward end portion of the one of said tubes extending into said piston drive bore being in fluid communication with one of said pair of second fluid ports, to thereby communicate pressurized fluid to said axial side of said second piston toward said body forward end;

seals positioned to provide a fluid-tight seal between said tube forward end portions at a location intermediate said conduit forward and rearward end portions, and said torque rod bores in which said tubes extend;

means for restraining said piston assembly against rotational movement relative to said shaft while permitting axial movement of said piston assembly relative to said shaft; and a pair of third fluid ports in said body to selectively communicate pressurized fluid to said conduit rearward end portion of the ones of said tubes extending into said device drive bores with said end openings, to thereby communicate pressurized fluid to the external device fluid ports, whereby the external device can be selectively, rotationally moved relative to said body by selected rotation of said shaft, and selectively, linearly moved relative to said body by selected axial movement of said piston assembly relative to said shaft, and the external device, at the various positions to which moved, can be selectively and remotely operated under fluid-power by the selected application of pressurized fluid to said third fluid ports in said body.

4. A fluid-powered actuator for selectively rotating and linearly moving a fluid-powered external device with at least one fluid port to communicate pressurized fluid thereto for the operation of the external device, comprising:

an outer generally cylindrical body having a forward end and a rearward end;

a first member extending generally coaxially within said body and supported for rotational movement relative to said body, said first member having a forward end toward said body forward end and a rearward end with a rearward wall toward said body rearward end, said rearward wall having a plurality of recesses opening at a face thereof toward said first member forward end, said first member further having a chamber extending longitudinally and generally coaxially through said first member from said rearward wall fully through to said first member forward end to define a chamber end opening at said first member forward end;

an annular first piston mounted for reciprocal axial movement within said body in a response to the application of fluid pressure to one or the other opposing axial sides thereof, said first piston having a central aperture through which said first member projects;

a pair of first fluid ports in said body to selectively communicate pressurized fluid to said opposing sides of said first piston;

first means for transmitting torque between said body and said first member to produce rotational movement of said first member relative to said body in response to axial movement of said first piston;

a second member including a second piston and a plurality of torque rods, said torque rods extending generally longitudinally within said first member chamber and being connected to said second piston for axial travel therewith, said second member being supported for axial movement relative to said first member, said second piston being mounted for reciprocal axial movement within said first member chamber in response to the application of fluid pressure to one or the other opposing axial sides thereof to produce axial movement of said second member relative to said first member, each of said torque rods projecting forwardly to said chamber end opening, and having a forward end and a rearward end with a bore extending generally axially through said torque rod from said torque rod rearward end to a position toward said torque rod forward end, one of said torque rod bores being a piston drive bore having a closed end toward said torque rod forward end and being in fluid communication with said axial side of said second piston toward said body forward end, and at least one of said torque rod bores being a device drive bore extending fully through to said torque rod forward end to define an end opening at said torque rod forward end, said torque rod bores being in generally coaxial alignment with said first member bores in said rearward wall;

a pair of second fluid ports in said body to selectively communicate pressurized fluid to said opposing axial sides of said second piston;

means for attachment of the external device to said second member at said torque rod forward end with the external device fluid port in fluid communication with said end opening of said device drive bore;

a plurality of fluid conducting tubes, each said tube having a rearward end portion positioned in one of said first member bores and a forward end portion extending forward of said rearward wall into one of said torque rod bores a sufficient axial distance to maintain said tube positioned at least partially within said torque rod bore as said second member axially reciprocates within said first member chamber between an end limit of travel toward said body forward end and an end limit of travel toward said body rearward end, said torque rods being axially movable relative to said tube forward end portions for reciprocal axial movement relative to said first member, each of said tubes having a longitudinally extending interior fluid conduit for communicating pressurized fluid between a rearward end portion of said conduit at said tube rearward end portion and a forward end portion of said conduit at said tube forward end portion, with said conduit forward end portion positioned to remain in fluid communication with the one of said torque bores in which said tube extends during the entire axial travel of said second member between said end limits of travel, said conduit rearward end portion of the one of said tubes extending into said piston drive bore being in fluid communication with one of said pair of second fluid ports, to thereby communicate pressurized fluid to said axial side of said second piston toward said body forward end;

seals located to provide a fluid-tight seal between said tube forward end portions at a location intermediate said conduit forward and rearward end portions, and said torque rod bores in which said tubes extend;

means for restraining said second member against rotational movement relative to said first member while permitting axial movement of said second member relative to said first member; and at least one third fluid port in said body to selectively communicate pressurized fluid to said conduit rearward end portion of the one of said tubes extending into said device drive bore with said end opening, to thereby communicate pressurized fluid to the external device fluid port, whereby the external device can be selectively, rotationally moved relative to said body by selected rotation of said first member, and selectively, linearly moved relative to said body by selected axial movement of said second member relative to said first member, and the external device, at the various positions to which moved, can be selectively and remotely operated under fluid-power by the selected application of pressurized fluid to said third fluid port in said body.

5. A fluid-powered actuator for selectively rotating and linearly moving a fluid-powered external device with at least one fluid port to communicate pressurized fluid thereto for the operation of the external device, comprising:

an outer body having a forward end and a rearward end and a body chamber axially extending therebetween within said body;

a first member extending generally coaxially within said body chamber and supported for rotational movement relative to said body, said first member having a forward end toward said body forward end and a rearward end with a rearward wall toward said body rearward end, said rearward wall having a plurality of recesses opening at a face thereof toward said first member rearward end to and fully through a face thereof toward said first member forward end, said first member further having a chamber extending longitudinally and generally axially through said first member from said rearward wall fully through to said first member forward end to define a chamber end opening at said first member forward end;

a first piston mounted for reciprocal axial movement within said body chamber in a response to the application of fluid pressure to one or the other opposing axial sides thereof;

a pair of first fluid ports to selectively communicate pressurized fluid to said opposing sides of said first piston;

first means for transmitting torque between said body and said first member to produce rotational movement of said first member relative to said body in response to axial movement of said first piston;

a second member extending generally longitudinally within said first member chamber and supported for axial movement relative to said first member, said second member projecting forwardly beyond said chamber end opening, and having a forward end and a rearward end with a plurality of apertures extending generally axially through said second member from said second member rearward end to a position toward said second member forward end, said second member apertures including a piston aperture, and at least one device drive aperture extending fully through to said second member forward end to define an end opening at said second member forward end, said second member apertures being in generally axial alignment with said first member recesses in said rearward wall;

a second piston mounted for reciprocal axial movement within said first member chamber in response to the application of fluid pressure to one or the other opposing axial sides thereof, said second piston operatively engaging said second member to produce axial movement of said second member relative to said first member, said piston drive aperture being in fluid communication with said axial side of said second piston toward said body forward end;

a pair of second fluid ports to selectively communicate pressurized fluid to said opposing axial sides of said second piston;

means for attachment of the external device to said second member at said second member forward end with the external device fluid port in fluid communication with said end opening of said device drive aperture;

a plurality of elongated fluid conductors having a rearward end portion positioned in said first member recess and a forward end portion extending forward of said rearward wall into said second member apertures a sufficient axial distance to maintain said conductors positioned at least partially within said second member apertures as said second member axially reciprocates within said first member chamber between an end limit of travel toward said body forward end and an end limit of travel toward said body rearward end, said second member being axially movable relative to said conductor forward end portions for reciprocal axial movement relative to said first member, each of said conductors having a longitudinally extending interior fluid conduit for communicating pressurized fluid between a rearward end portion of said conduit at said conductor rearward end portion and a forward end portion of said conduit at said conductor forward end portion, with said conduit forward end portion positioned to remain in fluid communication with the one of said second member apertures in which said conductor extends during the entire axial travel of said second member between said end limits of travel, said conduit rearward end portion of the one of said conductors extending into said piston drive apertures being in fluid communication with one of said pair of second fluid ports, to thereby communicate pressurized fluid to said axial side of said second piston toward said body forward end;

seal means for providing a fluid-tight seal between said conductor forward end portions at a location intermediate said conduit forward and rearward end portions, and said second member apertures in which said conductors extend;

means for restraining said second member against rotational movement relative to said first member while permitting axial movement of said second member relative to said first member; and at least one third fluid port to selectively communicate pressurized fluid to said conduit rearward end portion of the one of said conductors extending into said device drive aperture with said end opening, to thereby communicate pressurized fluid to the external device fluid port, whereby the external device can be selectively, rotationally moved relative to said body by selected rotation of said first member, and selectively, linearly moved relative to said body by selected axial movement of said second member relative to said first member, and the external device, at the various positions to which moved, can be selectively and remotely operated under fluid-power by the selected application of pressurized fluid to said third fluid port.

6. The actuator of claim 5 wherein said second member includes a plurality of torque rods, said torque rods extending generally coaxially within said first member chamber and being connected to said second piston for axial travel therewith, said torque rods being supported for axial movement as a unit relative to said first member, each of said torque rods projecting forwardly to said chamber end opening, and having a forward end and a rearward end, and wherein said second member apertures include a bore extending generally axially through each of said torque rods from said torque rod rearward end to a position toward said torque rod forward end, one of said torque rod bores being a piston drive bore having a closed end toward said torque rod forward end and being in fluid communication with said axial side of said second piston toward said body forward end, and at least one of said torque rod bores being a device drive bore extending fully through to said torque rod forward end to define an end opening at said torque rod forward end, said torque rod bores being in generally axial alignment with said first member recesses in said rearward wall, and wherein each of said conductor forward end portions extending forward of said rearward wall extend into one of said torque rod bores a sufficient axial distance to maintain said conductors positioned at least partially within said torque rod bores as said torque rods axially reciprocate as a unit within said first member chamber between an end limit of travel toward said body forward end and an end limit of travel toward said body rearward end, said torque rods being axially movable relative to said conductor forward end portions for reciprocal axial movement relative to said first member.

7. The actuator of claim 6 wherein said seal means includes seals located to provide a fluid-tight seal between said conductor forward end portions at a location intermediate said conduit forward and rearward end portions, and said torque rod bores in which said conductors extend

8. The actuator of claim 6 wherein said restraining means includes a guide wall member attached to said first member at said first member forward end for rotation therewith, said guide wall member including a plurality of spaced apart apertures therethrough sized and spaced to each slidably receive one of said torque rod forward ends therein and inhibit rotation of said torque rods relative to said first member as said torque rods moves axially relative to said first member.

9. A fluid-powered actuator for selectively rotating and linearly moving a fluid-powered external device with at least one fluid port to communicate pressurized fluid thereto for the operation of the external device, comprising:

an outer body having a forward end and a rearward end and a body chamber axially extending therebetween within said body;

a first member extending generally coaxially within said body chamber and supported for rotational movement relative to said body, said first member having a forward end toward said body forward end and a rearward end with a rearward wall toward said body rearward end, said rearward wall having a plurality of recesses opening at a face thereof toward said first member rearward end to and fully through a face thereof toward said first member forward end, said first member further having a chamber extending longitudinally and generally axially through said first member from said rearward wall fully through to said first member forward end to define a chamber end opening at said first member forward end;

a pair of first fluid ports;

first means for producing rotational movement of said first member relative to said body in response to the application of fluid pressure to one or the other of said first fluid ports;

a second member extending generally longitudinally within said first member chamber and supported for axial movement relative to said first member, said second member projecting forwardly beyond said chamber end opening, and having a forward end and a rearward end with a plurality of apertures extending generally axially through said second member from said second member rearward end to a position toward said second member forward end, said second member apertures including a piston aperture, and at least one device drive aperture extending fully through to said second member forward end to define an end opening at said second member forward end, said second member apertures being in generally axial alignment with said first member recesses in said rearward wall;

a piston mounted for reciprocal axial movement within said first member chamber in response to the application of fluid pressure to one or the other opposing axial sides thereof, said piston operatively engaging said second member to produce axial movement of said second member relative to said first member, said piston drive aperture being in fluid communication with said axial side of said piston toward said body forward end;

a pair of second fluid ports to selectively communicate pressurized fluid to said opposing axial sides of said piston;

means for attachment of the external device to said second member at said second member forward end with the external device fluid port in fluid communication with said end opening of said device drive aperture;

a plurality of elongated fluid conductors having a rearward end portion positioned in said first member recess and a forward end portion extending forward of said rearward wall into said second member apertures a sufficient axial distance to maintain said conductors positioned at least partially within said second member apertures as said second member axially reciprocates within said first member chamber between an end limit of travel toward said body forward end and an end limit of travel toward said body rearward end, said second member being axially movable relative to said conductor forward end portions for reciprocal axial movement relative to said first member, each of said conductors having a longitudinally extending interior fluid conduit for communicating pressurized fluid between a rearward end portion of said conduit at said conductor rearward end portion and a forward end portion of said conduit at said conductor forward end portion, with said conduit forward end portion positioned to remain in fluid communication with the one of said second member apertures in which said conductor extends during the entire axial travel of said second member between said end limits of travel, said conduit rearward end portion of the one of said conductors extending into said piston drive apertures being in fluid communication with one of said pair of second fluid ports, to thereby communicate pressurized fluid to said axial side of said piston toward said body forward end;

seal means for providing a fluid-tight seal between said conductor forward end portions at a location intermediate said conduit forward and rearward end portions, and said second member apertures in which said conductors extend;

means for restraining said second member against rotational movement relative to said first member while permitting axial movement of said second member relative to said first member; and at least one third fluid port to selectively communicate pressurized fluid to said conduit rearward end portion of the one of said conductors extending into said device drive aperture with said end opening, to thereby communicate pressurized fluid to the external device fluid port, whereby the external device can be selectively, rotationally moved relative to said body by selected rotation of said first member, and selectively, linearly moved relative to said body by selected axial movement of said second member relative to said first member, and the external device, at the various positions to which moved, can be selectively and remotely operated under fluid-power by the selected application of pressurized fluid to said third fluid port.

* * * * *

UNITED STATES PATENT AND TRADEMARK OFFICE

CERTIFICATE OF CORRECTION

PATENT NO. : 4,987,825

DATED : January 29, 1991

INVENTOR(S) : Paul P. Weyer

It is certified that error appears in the above-identified patent and that said Letters Patent is hereby corrected as shown below:

In column 19, claim 3, line 8, after "end;" please insert -- an annular first piston mounted for reciprocal --.

Signed and Sealed this

Seventeenth Day of November, 1992

*Attest:*

DOUGLAS B. COMER

*Attesting Officer*

*Acting Commissioner of Patents and Trademarks*